United States Patent [19]

Yoshiki et al.

[11] Patent Number: 4,957,202

[45] Date of Patent: Sep. 18, 1990

[54] COMMODITY PACKAGE WITH AUXILIARY CONTAINER PORTION

[75] Inventors: Kanetsugu Yoshiki; Takanaga Urayama, both of Osaka, Japan

[73] Assignee: Sunstar Kabushiki Kaisha, Osaka, Japan

[21] Appl. No.: 396,199

[22] Filed: Aug. 21, 1989

[51] Int. Cl.[5] ..... B65D 5/50

[52] U.S. Cl. ..... 206/44.11; 206/45.14; 206/277

[58] Field of Search ..... 206/44.11, 44 R, 45.14, 206/45.19, 485, 277; 229/9

[56] References Cited

U.S. PATENT DOCUMENTS 2,643,811 6/1953 Bolding ..... 206/44.11
2,773,589 12/1956 Hennessey ..... 206/44.11
3,054,505 9/1962 Hennessey ..... 206/44.11
3,747,831 7/1973 Hanson ..... 206/277
4,392,605 7/1983 Backman ..... 229/9

*Primary Examiner*—Paul T. Sewell
*Assistant Examiner*—Jacob A. Ackun, Jr.
*Attorney, Agent, or Firm*—Sughrue, Mion, Zinn, Macpeak & Seas

[57] ABSTRACT

A commodity package includes a body, a part of an outer surface of the body being recessed inwardly of the body to provide an auxiliary container portion for containing an auxiliary commodity therein. A transparent cover member is attached to the body to cover at least the auxiliary container portion containing the auxiliary commodity therein.

5 Claims, 5 Drawing Sheets

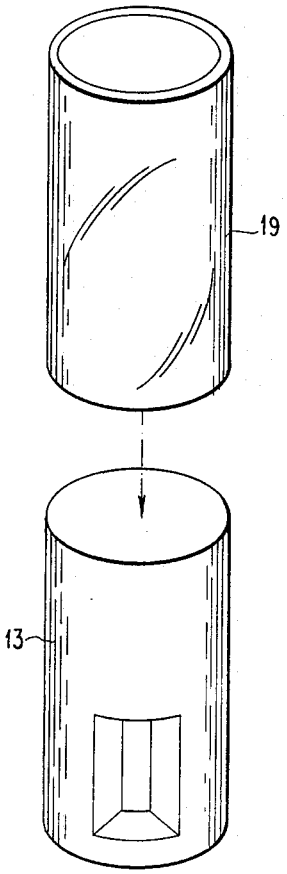
FIG. 5
FIG. 6 PRIOR ART
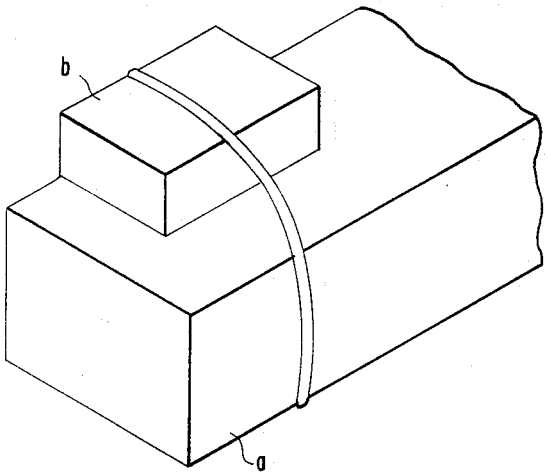

COMMODITY PACKAGE WITH AUXILIARY CONTAINER PORTION

FIELD OF THE INVENTION

The present invention relates generally to a commodity package having an auxiliary container portion, and more particularly to such a commodity package in which the auxiliary container portion is not projected outwardly from the outer surface of the package body, thereby facilitating the packing of the commodity packages at the time of the transport and storage thereof, and also facilitating the stacking of the commodity packages for display purposes, and in which an auxiliary commodity contained in the auxiliary container portion can be viewed from the outside.

BACKGROUND OF THE INVENTION

Conventionally, when attaching an auxiliary commodity, such as a premium article or a trade sample, to a commodity package containing a main commodity, the naked auxiliary commodity is affixed to the outer surface of the commodity package, using a sutable adhesive or fastening tape. Another alternative is, for example, to provide a separate auxiliary container box b containing the auxiliary commodity and to attach the auxiliary container box b to the outer surface of the commodity package a using a rubber band, an adhesive tape or the like, as shown in FIG. 6. Alternatively, the auxiliary container and the commodity package are enclosed together by a shrink film.

Such conventional methods of attaching the auxiliary commodity to the commodity package much detract from the appearance of the commodity, and also are disadvantageous in that because of the presence of the projected portion (the auxiliary commodity or the auxiliary container box) on the outer surface of the commodity package, the packing of the commodity packages for transport purposes and the stacking of the commodity packages for display at stores are difficult. Further, in most cases, the auxiliary container box is made entirely of paper, and therefore the auxiliary commodity contained in such an auxiliary container box is not viewed from the outside, which is disadvantageous from the viewpoint of publicity or advertisement. Further, since the auxiliary commodity is attached to the outer surface of the commodity package at a later stage, the step of attaching the auxiliary commodity can not be carried out at the same time when the step of containing the main commodity in the commodity package is carried out. Therefore, the auxiliary commodity must be attached manually at the time of either the shipment or the display at stores.

SUMMARY OF THE INVENTION

It is therefore an object of the present invention to provide a commodity package with an auxiliary container portion, in which the packing for transport purposes and the stacking for display purposes can be done easily, and an auxiliary commodity can be viewed from the outside to effectively attract the attention of the consumer, and the attachment of the auxiliary commodity can be carried out at the same time when a main commodity is contained in the commodity package.

The above and other objects and effects of the present invention will be apparent from the following description.

According to the present invention, there is provided a commodity package comprising a body, a part of an outer surface of said body being recessed inwardly of said body to provide an auxiliary container portion for containing an auxiliary commodity therein; and a transparent cover member attached to said body to cover at least said auxiliary container portion containing the auxiliary commodity therein.

In the commodity package with the auxiliary container portion according to the present invention, after the main commodity is contained in the package body, the auxiliary commodity is received in the auxiliary container portion recessed in the surface of the package body. The transparent cover material is applied to the package body in such a manner that at least the auxiliary container portion is covered by the transparent cover member. After the transparent cover member is applied to the package body, the commodity package has no portion which projects from the outer surfaces of the package body. The maximum outer size of the commodity package of the present invention is the same as that of a conventional commodity package having no auxiliary container portion. Therefore, the commodity package of the present invention can be handled easily, and the packing of the commodity packages for transport purposes, as well as the stacking of the commodity packages for display purposes, can be carried out easily as is the case with conventional commodity packages. Further, the auxiliary commodity contained in the auxiliary container portion can be viewed through the transparent cover member from the outside, the auxiliary commodity can appeal to the consumer.

BRIEF DESCRIPTION OF THE DRAWINGS

FIG. 2(*b*) is a cross-sectional view taken along the line X—X of FIG. 2(*a*);

FIG. 3(*b*) is a fragmentary front-elevational view of the commodity package of FIG. 3(*a*);

FIG. 4(*a*) is a fragmentary front-elevational view of the commodity package of FIG. 4(*a*);

FIG. 5 is a perspective view of a further modified commodity package; and

FIG. 6 a fragmentary perspective view of a conventional commodity package.

DESCRIPTION OF THE PREFERRED EMBODIMENTS OF THE INVENTION

The invention will now be described with reference to the drawings.

In FIGS. 1 to 5, the present invention is embodied in paper cases (commodity packages) for containing tubes of toothpaste.

Figure 1A:
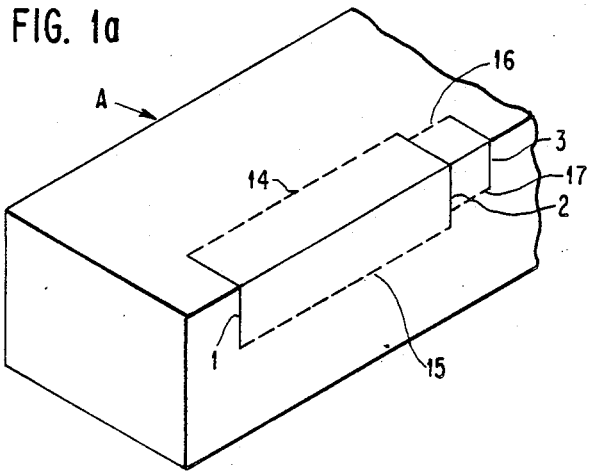
FIGS. 1(*a*) and 1(*b*) are fragmentary perspective views of one embodiment of a commodity package with an auxiliary container portion provided in accordance with the present invention, the commodity package comprising a paper case for containing a toothpaste tube.
Figure 1B:
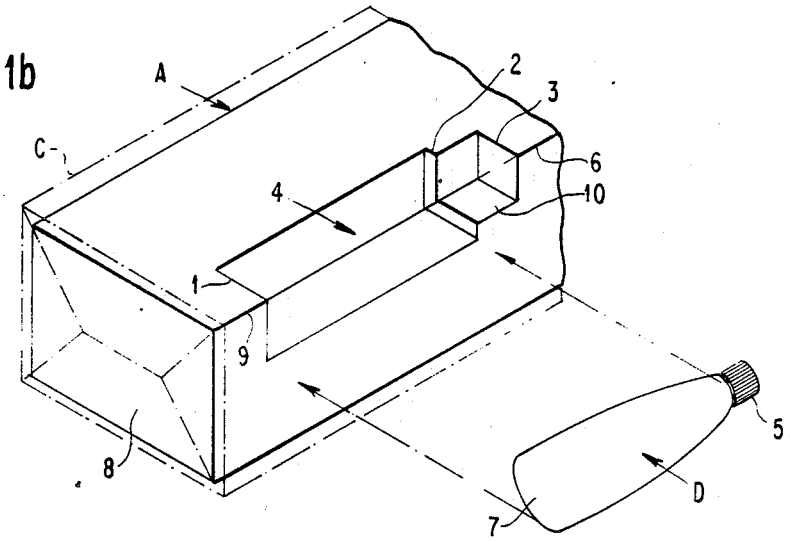
Figure 2A:
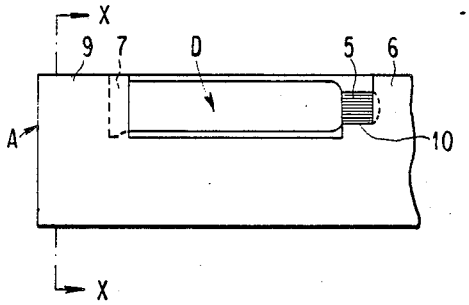
FIG. 2(*a*) is a fragmentary front-elevational view of the commodity package.
Figure 2B:
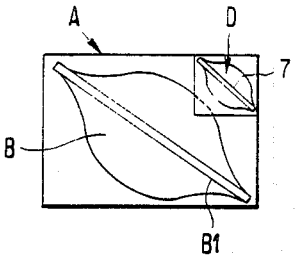

A commodity package shown in FIGS. 1 and 2 comprises a box-shaped body A of a square cross-section for containing a tube B of toothpaste therein. As shown in FIG. 1(*a*), three parallel spaced slits 1, 2 and 3 are formed in one of four longitudinal corner portions which is defined by one side wall of the box-shaped body A and its top wall, the three slits being disposed in the vicinity of one end wall 8 of the box-shaped body A adjacent to which a flattened tail B1 of the toothpaste tube B (FIG. 2(*b*)) is disposed. More specifically, each of the three slits 1, 2 and 3 is formed through the one side wall and the top wall of the box-shaped body A, and extends transversely of the one longitudinal corner portion of the box-shaped body A, the spacing between the slits 1 and 2 as well as the spacing between the slits 2 and 3 being predetermined.

A pair of parallel lines 14 and 15 of weakness (defined by discrete cuts) are formed respectively in the top wall and the one side wall of the box-shaped body A and extend longitudinally between the first and second slits 1 and 2. Similarly, a pair of parallel lines 16 and 17 of weakness are formed respectively in the top wall and the one side wall of the box-shaped body A and extend longitudinally between the second and third slits 2 and 3. The weakness lines 14, 15, 16 and 17 serve to guide the bending of the one longitudinal corner portion of the box-shaped body A. The first and second slits 1 and 2 has the same length, and the third slit 3 is slightly shorter. That section of the one longitudinal corner portion of the box-shaped body A extending between the first and second slits 1 and 2, as well as that section of the one longitudinal corner portion extending between the second and third slit 2 and 3, is pressed to be bent or recessed inwardly of the box-shaped body A to thereby form an auxiliary container portion 4 at the one longitudinal corner portion, as shown in FIG. 1(*b*). The size and shape of the auxiliary container portion 4 are suitably determined in accordance with the size and shape of an auxiliary commodity to be contained therein.

In this embodiment, the auxiliary commodity is a small tube D of toothpaste. The section of the one longitudinal corner portion extending between the second and third slits 2 and 3 are bent inwardly of the box-shaped body A to provide a stepped surface 10 at the auxiliary container portion 4. As shown in FIG. 2(*a*), a cap 5 for the small toothpaste tube D is placed on the stepped surface 10, and the distal end of the cap 5 is disposed in contiguous relation to the inner surface of the section 6 of the one longitudinal corner portion disposed adjacent to the third slit 3. Also, a tail 7 of the small toothpaste tube D is disposed in contiguous relation to the inner surface of the section 9 of the one longitudinal corner portion disposed adjacent to the first slit 1. Thus, the small toothpaste tube D is retained in position in the auxiliary container portion 4 in a stable manner. The above-mentioned sections 6 and 9 serve as stoppers for retaining the auxiliary commodity in position, and prevent the small toothpaste tube D from dropping from the auxiliary container portion 4 before a transparent cover sheet C is applied to the box-shaped body A. Also, these sections 6 and 9 serve to prevent the small toothpaste tube D from rattling even when an impact or vibration is applied to the box-shaped body A during its transport. The provision of such stoppers is not of absolute necessity, and the small toothpaste tube D can be merely accommodated within the auxiliary container portion 4, in which case the dropping of the tube D is prevented by the transparent cover sheet C tightly wrapped on the box-shaped body A.

Figure 3A:
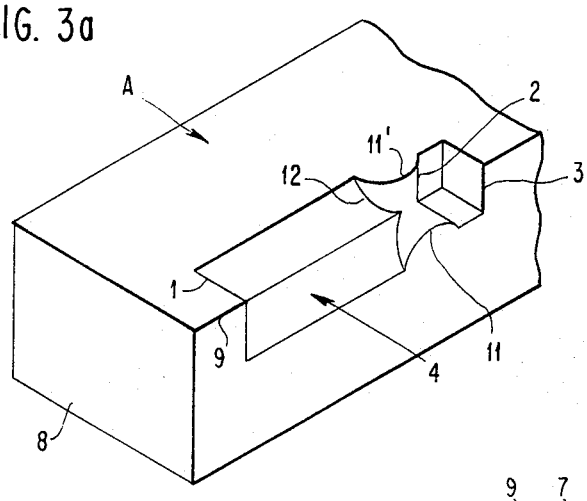
FIG. 3(*a*) is a fragmentary perspective view of a modified commodity package.
Figure 3B:
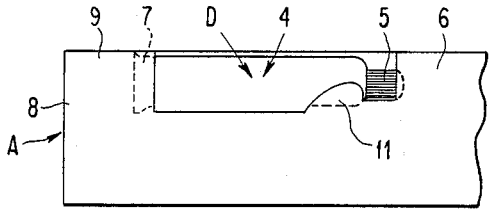

The stoppers may take another form. For example, as shown in FIG. 3(*a*), in addition to the three slits 1, 2 and 3, another slit 12, defined by two curved lines, is formed in the one longitudinal corner portion. When that section of the one longitudinal corner portion extending between the first and second slits 1 and 2 is pressed or recessed to provide the auxiliary container portion 4, this section partially remains intact to provide retaining sections 11 and 11' lying respectively in the planes of the one side wall and the top wall of the box-shaped body A. The retaining sections 11 and 11' serve to prevent the auxiliary commodity from dropping from the auxiliary container portion 4. In this case, the small toothpaste tube D is positively retained by the retaining sections 11 and 11' and the corner sections 6 and 9, as shown in FIG. 3(*b*).

Figure 4A:
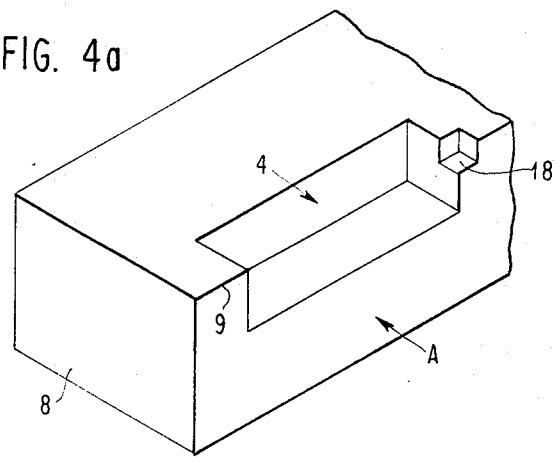
FIG. 4(*a*) is a fragmentary perspective view of another modified commodity package.
Figure 4B:
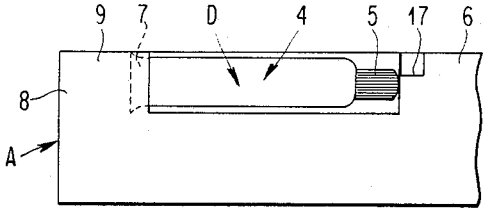

Also, the length of the third slit 3 can be shorter to provide a shallow stepped surface 18, as shown in FIG. 4. In this case, the corner section 9 prevents the small toothpaste tube D from being dropped from the auxiliary container portion 4, and the rattling of the tube D in the longitudinal direction of the box-shaped body A is prevented by the distal edge of the stepped surface 18 held in contact with the distal end of the cap 5 of the tube D.

The above-mentioned forms of auxiliary container portions 4 can be provided merely by forming the slits at predetermined regions in a stock sheet of paper for forming the box-shaped body A, and any additional part is required for forming the auxiliary container portion. However, in the case where the auxiliary container portion 4 is complicated in shape, for example, to receive therein other product than a toothpaste tube, an additional part may be used.

After the auxiliary commodity is stably accommodated within the auxiliary container portion 4 as described above, the transparent cover sheet C such as a shrink film is applied to the box-shaped body A to cover the same, thus completing the commodity package. In the above embodiments, although a shrink film is used as the transparent cover material, any other suitable material can be used so long as it is transparent. For example, in the case where the commodity package comprises a hollow cylindrical body or case 13 made of paper as shown in FIG. 5, it is preferred that the transparent cover member comprise a hollow cylindrical member 19 made of a rigid synthetic resin, in order to prevent the deformation of the paper case 13.

In the above embodiments, although the auxiliary container portion 4 is provided in the vicinity of the end wall 8 of the box-shaped body A, that is, at a position where the reduced-size portion of the toothpaste tube B is disposed, so as to prevent the tail B1 of the toothpaste tube B from moving within the box-shaped body A. Also, in the embodiment shown in FIG. 5, the auxiliary container portion may be provided at a position where the neck portion of a bottle-shaped main commodity contained in the paper case 13 is disposed. However, the position of the provision of the auxiliary container portion 4 is not limited to such embodiments and can be suitably determined depending on the shape of the main commodity.

For using the above embodiments of the commodity package of the present invention (i.e., the case for a toothpaste tube), the folded paper sheet is first assembled into the box-shaped body A. Then, the section extending between the first and second slits 1 and 2, as well as the section extending between the second and third slits 2 and 3, are pressed or recessed inwardly of the box-shaped body A to provide the auxiliary container box 4 and the stepped surface 10. Because the weakness lines 14, 15, 16 and 17 are preformed at these sections so as to guide the bending thereof, the formation of the auxiliary container portion 4 by pressing can easily be carried out. Alternatively, the arrangement of the slits as well as the arrangement of the weakness lines can be suitably modified in such a manner that simultaneously when the folded paper sheet is assembled into the box-shaped body A, the section extending between the slits 1 and 2 is recessed inwardly of the box-shaped body.

After the box-shaped body A is assembled into its predetermined arrangement, the main commodity, i.e., the toothpaste tube B, is inserted into the body A, and then the small toothpaste tube D is received in the auxiliary container portion 4 in such a manner that the tube D is suitably retained by the stoppers. In the above embodiments, although only one auxiliary container portion 4 is provided at the one longitudinal corner portion of the box-shaped body A, another auxiliary container portions can be provided at the longitudinal corner portion disposed in diagonal relation to the one longitudinal corner portion, if the retaining of the auxiliary commodities by the stoppers can be made more positive.

After the toothpaste tube B and the small toothpaste tube D are contained within the box-shaped body A and the auxiliary container portion 4, respectively, the transparent cover sheet C is wrapped on the box-shaped body A to cove the same, thus completing the commodity package. In this condition, the small toothpaste tube D can be viewed from the outside and is immovably retained in the auxiliary container portion 4. The main commodity, i.e., the toothpaste tube B, is prevented from movement within the box-shaped body A because of the provision of the auxiliary container portion 4, and therefore the toothpaste tube B is retained in a stable manner without rattling.

The stock paper sheet for forming the box-shaped body A can be prepared merely by suitably forming the slits and the weakness lines in a conventional stock paper sheet. Thus, the conventional stock paper sheet can be used, and it can be worked or processed easily. After the box-shaped body A is assembled, nothing projects from the outer surfaces of the body A, and therefore the packing of the commodity package at the time of the transport and storage can be carried out easily. Also, since the commodity packages can be properly stacked one upon another when they are displayed at stores, they are space-saving, and can be handled easily as is the case with ordinary commodity packages.

Further, the auxiliary commodity contained in the auxiliary container portion 4 can be viewed through the transparent sheet C from the outside, and therefore if a premium article, a publicity article, an instruction leaflet or the like is contained in the auxiliary container portion 4, this attracts the attention of the consumer, thus enhancing the effect of the publicity and advertisement. Further, the auxiliary commodity contained in the auxiliary container portion 4 is positively retained in position by the stoppers and the transparent sheet, the auxiliary commodity does not rattle even if the commodity package is handled relatively roughly. Further, since the auxiliary commodity is applied to the box-shaped body A prior to the application of the transparent sheet C to the body A, the application of the auxiliary ammodity can be done in the same step in which the main commodity is introduced into the box-shaped body A. Thus, a manual attachment of such an auxiliary commodity to the conventional commodity package at the time of shipment or display at stores can be omitted.

As described above, in the commodity packages with the auxiliary container portion, provided in accordance with the present invention, the auxiliary commodity is accommodated within the package in such a manner that no part projects from the outer surfaces of the package. Therefore, the commodity packages can be stacked one upon another when they are displayed at stores, thus saving the space, and they can be displayed as is the case with ordinary commodity packages. Further, since the auxiliary commodity can be viewed through the transparent cover material from the outside, this attracts the attention of the consumer and therefore is very advantageous from the viewpoint of publicity and advertixement. Further, the packing of the commodity packages for transport or storage purposes can be easily done, and at this time a conventional packing case can be used.

While the invention has been described in detail and with reference to specific examples thereof, it will be apparent to one skilled in the art that various changes and modifications can be made therein without depating from the spirit and scope thereof.

What is claimed is:

1. A commodity package comprising a body of box-shape with a rectangular cross-section, said box-shaped body being made of paper, first, second and third parallel slits formed in a corner portion of said body transversely to the longitudinal axis of said body, said slits being spaced a predetermined distance from each other along said corner portion, weakened fold lines extending parallel to each other and parallel to the longitudinal axis of the body and extending between respective ones of said slits to define two separate corner portions of said body bent inwardly of the body to form an auxiliary container portion, defined at each end by right angle intersecting sides, one of said first and third slits on opposite sides of said second slit extends from said corner portion of said body along said right angle intersecting sides to an extent less than the others of said slits so as to form an inwardly bent reduced-sized portion of said auxiliary container portion at one axial end thereof functioning as a stopper means and abutting one end of said auxiliary commodity when positioned therein to prevent rattling of the auxiliary commodity contained in said auxiliary container portion with contact being effected between edges of said reduced-sized portion of said auxiliary container portion and said one end of said auxiliary commodity when positioned within said auxiliary container portion, and a transparent cover member attached to said body to cover at least said auxiliary container portion containing the auxiliary commodity therein.

2. The commodity package as claimed in claim 1, further comprising fourth and fifth curved slits extending towards each other from respective parallel weakened fold line on right angle sides of said rectangular cross-section box-shaped body at said corner portion of said body, said curved slits each forming an arcuate retaining section lying respectively in a plane of a respective right angle side wall as an extension thereof beyond said weakened fold line, and wherein said curved slits lie between two of said three slits such that each said retaining section contacts the auxiliary commodity intermediate opposite ends of said auxiliary commodity.

3. A commodity package as claimed in claim 1, wherein said commodity package is a package for containing a toothpaste tube.

4. A commodity package as claimed in claim 1, wherein said auxiliary container portion is disposed proximate to a tail portion of said toothpaste tube.

5. A commodity package comprising a body of boxed-shape with a rectangular cross-section, said box-shaped body being made of paper, first, second and third slits formed in a corner portion of said body transversely to the longitudinal axis of said body, said first, second and third slits being spaced a predetermined distance from each other along said corner portion, weakened fold lines extending parallel to each other and parallel to the longitudinal axis of the body and extending between respective ones of said slits to define two separate corner portions of said body bent inwardly of the body to form an auxiliary container portion, defined at each end by right angle intersecting sides wherein one of said first and third slits on opposite sides of the second slit extends from said corner portion of said body along said right angle intersecting sides to an extent less than the others of said slits so as to form an inwardly bent reduced-sized portion of said auxiliary container portion at one axial end thereof functioning as a stopper means and abutting one end of said auxiliary commodity when positioned therein to prevent rattling of the auxiliary commodity contained in said auxiliary container portion with contact being effected between edges of said reduced-size portion of said auxiliary container portion and said one end of said auxiliary commodity when positioned within said auxiliary container portion and wherein said third slit and a fourth slit comprise curved slits extending towards each other from respective parallel weakened fold lines on right angle sides of said rectangular cross-section box-shaped body at said corner portion of said body, said curved slits each forming an arcuate retaining section lying respectively in the planes of respective right angle side walls and forming an extension thereof beyond said weakened fold line, and wherein said curved slits lie between two of said three slits such that each said retaining section contacts the auxiliary commodity intermediate opposite ends of the auxiliary commodity, and said commodity package further comprising a transparent cover member attached to said body to cover at least said auxiliary container portion containing the auxiliary commodity therein.

* * * * *